US005601313A

United States Patent [19]

Konkol et al.

[11] Patent Number: 5,601,313

[45] Date of Patent: Feb. 11, 1997

[54] MULTIPART FORM AND LABEL COMBINATION

[75] Inventors: Patrick A. Konkol, Cincinnati; Lawrence W. Arway, Kettering; Loren Schafer, Dayton, all of Ohio; Cynthia S. Willard, Denver, Colo.; Hugh B. Skees, Dayton, Ohio

[73] Assignee: The Standard Register Company, Dayton, Ohio

[21] Appl. No.: 383,836

[22] Filed: Feb. 6, 1995

[51] Int. Cl.[6] ..... B42D 15/00

[52] U.S. Cl. ..... 283/81; 283/101; 283/108; 281/2; 281/5

[58] Field of Search ..... 283/81, 101, 98, 283/100, 108; 428/40.1, 42.2, 43, 195, 207, 914, 352, 194, 137, 202, 42.3, 42.1; 281/2.5

[56] References Cited

U.S. PATENT DOCUMENTS

| | | | |
|---|---|---|---|
| 4,584,219 | 4/1986 | Baartmans | 283/101 X |
| 4,695,077 | 9/1987 | Pretre | 283/81 |
| 4,910,058 | 3/1990 | Jameson | 283/101 X |
| 4,940,258 | 7/1990 | Cuba, Jr. et al. | 283/101 X |
| 4,983,438 | 1/1991 | Jameson | 283/101 X |
| 5,279,875 | 1/1994 | Juszak et al. | 283/81 X |
| 5,318,325 | 6/1994 | Ipsen | 283/81 |
| 5,330,232 | 7/1994 | Smith . | |
| 5,466,502 | 11/1995 | Wilkinson et al. . | |
| 5,482,328 | 1/1996 | Stewart | 283/81 |
| 5,487,568 | 1/1996 | Ipsen | 283/81 |

*Primary Examiner*—Frances Han

*Attorney, Agent, or Firm*—Killworth, Gottman, Hagan & Schaeff

[57] ABSTRACT

A multipart form and label combination is provided which may be printed in a single pass through a printer. The combination includes a face ply which may be printed with nonvariable and variable indicia, a film ply, and an optional intermediate liner ply. The combination also includes first, second or third removable portions such as, for example, a label, receipt or postcard. In a preferred embodiment, the multipart form and label combination is used as an inspection form.

32 Claims, 9 Drawing Sheets

MULTIPART FORM AND LABEL COMBINATION

BACKGROUND OF THE INVENTION

This invention relates to a multipart form and label combination, and more particularly, to a form and label combination including a printable face ply and a film ply in which portions of the combination may be separated and removed from the remainder of the combination.

Business forms such as invoices, labels, receipts and the like are widely used by businesses or governments to record a variety of transactions. Such forms typically contain printed nonvariable information (i.e., information which is the same on each form), as well as variable information such as names, addresses, etc., which may be printed at a later time by the user.

Frequently, several different forms are used during a transaction. For example, one business transaction may require the use of a shipping label, an invoice, and a customer receipt. However, a disadvantage of using multiple business forms is that the forms are typically produced separately, requiring separate manufacturing and printing operations. In addition, the time and labor involved in producing multiple forms for one transaction results in a significant cost to businesses.

Many attempts have been made to combine two or more business forms into a single form. For example, forms have been produced which include a label portion which may be removed from the remainder of the form and affixed to another surface. Such forms are typically comprised of several plies of paper, polymeric film, etc. and are coated on one or more surfaces with a pressure sensitive adhesive or release coating. However, such forms have been complex and expensive to manufacture as they require separate die cutting and printing steps.

Accordingly, the need still exists in the art for an improved construction for a printable, multi-part form which includes separable portions, is easy to manufacture, and on which variable and nonvariable information may be printed in a single pass through a printing press.

SUMMARY OF THE INVENTION

The present invention meets those needs by providing a multipart form and label combination on which variable and nonvariable information may be printed in a single pass by the manufacturer, and later printed with variable information by the user. The combination comprises a face ply, a film ply, and an optional intermediate ply, and includes one or more removable portions such as, for example, a label, receipt or postcard. The multipart form and label combination of the present invention may be printed using a variety of printers including mechanical impact, thermal transfer, direct thermal, ink jet, and laser printers.

In accordance with one embodiment of the invention, a multipart form and label combination is provided comprising a printable face ply having first and second major surfaces and a film ply which is adhered to the face ply. The face ply is preferably thermally imagable and may be preprinted by the manufacturer in a single pass with variable and nonvariable information and later printed with variable information by a business or government agency. The film ply is preferably transparent and has a pressure sensitive adhesive on at least a portion of one surface which is adhered to the second surface of the face ply. The film ply may also be preprinted with nonvariable information.

In a preferred embodiment, the combination further includes first and second portions which are removable from the remainder of the combination. Preferably, the first and second portions are separated by die cuts or by perforations which extend through the face ply.

The face ply of the first portion includes a die cut label having a removable peripheral matrix. When the peripheral matrix is removed, the adhesive on the underlying film ply is exposed, and may be used to affix the label to a transparent surface so that the printed information on the label is visible through the transparent substrate. In this embodiment, the second surface of the face ply preferably includes a release coating in the area comprising the peripheral matrix so that the peripheral matrix of the face ply may be readily peeled from the film ply while the die cut label remains adhered to the film ply.

The second portion of the combination is also removable and may be used as an adhesive label or a postcard. Where the second portion is used as a label, at least a portion of the second surface of the face ply includes a pressure sensitive adhesive. The surface of the film ply which is adhered to the second portion of the face ply includes a release coating such that the face ply of the second portion may be peeled away from the film ply and adhered to another surface. For example, the face ply of the second portion may be printed with an address such that the label can be removed and adhered to a postcard for mailing. Preferably, an edge of the second surface of the face ply is free of adhesive so as to provide a clean lifting edge for separating the face ply from the film ply.

In an alternative embodiment where the second portion is to be used as a postcard, the film ply is preferably adhered only to the face ply of the first portion and a paper ply is adhered to the face ply of the second portion. In this embodiment, a pressure sensitive adhesive is included around the periphery of the second surface of the face ply of the second portion for adhering to the paper ply. Thus, the face ply and paper ply are laminated together and may be removed as one sheet from the remainder of the combination.

In a preferred embodiment of the invention, the multipart form and label combination includes a third portion which is removable from the combination. The third portion may be, for example, a receipt which is removed from the combination and retained by a customer. The third portion is preferably defined by die cuts or perforations extending through the face ply. In one embodiment, the film ply is die cut into two separate portions which are adhered to the first and second portions of the face ply such that the third portion of the combination comprises only the face ply. In an alternative embodiment, the film ply is adhered only to the first and third portions of the face ply such that the second portion comprises only the face ply.

In another preferred embodiment of the invention, the multipart form and label combination includes an intermediate ply between the face ply and the film ply. Preferably, the face ply, intermediate liner ply, and film ply are coextensive. In this embodiment, the first surface of the liner ply is adhered to the second surface of the face ply and the second surface of the liner ply is adhered to the film ply which has a pressure sensitive adhesive on its surface. Preferably, the second surface of the liner ply includes a release coat so that the liner ply may be readily peeled from the film ply.

The combination also includes first and second portions which are removable from the remainder of the combination. The first and second portions are preferably separated by die cuts or perforations extending through the face ply and intermediate liner ply. The film ply may optionally be die cut to correspond with the first and second portions of the face ply and liner ply.

The face ply and liner ply of at least the first portion include a die cut label having a removable peripheral matrix to expose the pressure sensitive adhesive on the film ply. Preferably, at least a portion of the second surface of the face ply includes a pressure sensitive adhesive such that the face ply is adhered to the intermediate liner ply. In one embodiment, the adhesive is included on the first and second portions of the face ply. In an alternative embodiment, the adhesive is included on the second portion of the face ply, but only on the die cut label of the first portion of the face ply.

The liner ply of the second portion preferably includes a release coat on its first surface such that the face ply of the second portion may be peeled from the liner ply and adhered to another surface. Preferably, an edge of the second surface of the face ply of the second portion is free of adhesive so that a clean lift edge is provided for peeling the face ply from the liner ply.

Preferably, the first surface of the liner ply of the first portion does not include a release coating such that the face ply and liner ply are laminated together by the pressure sensitive adhesive on the face sheet. Thus, the peripheral matrix may be peeled away as a single sheet from the film ply, while the label portion remains adhered to the film ply.

The combination preferably includes a third portion which is removable from the combination. The third portion is defined by perforations or die cuts extending through the face ply and liner ply.

In yet another embodiment of the invention, a multipart inspection form and label combination is provided which may be used for vehicle inspections, restaurant inspections, safety inspections, and the like. The inspection form and label combination preferably comprises a face ply having first and second major surfaces and containing variable and nonvariable indicia. The combination also includes an intermediate liner ply and a film ply.

The face ply, intermediate liner ply, and film ply are preferably coextensive. The first surface of the liner ply is adhered to the second major surface of the face ply, and the second surface of the liner ply is adhered to the film ply with an adhesive. The combination includes a die cut label portion and a second portion which are removable from the remainder of the combination. In one embodiment, the second portion comprises a label which may be affixed to another surface. In an alternative embodiment, the second portion comprises a postcard.

Preferably, the face ply includes a pressure sensitive adhesive on its second surface which is adhered to the first surface of the intermediate liner ply. Where the second portion comprises a label, the intermediate liner ply includes a release coat on the first surface of the second portion so that the face ply of the second portion may be peeled from the intermediate liner ply and adhered to another surface. Where the second portion comprises a postcard, the intermediate liner ply does not include a release coat on the first surface of the second portion such that the face ply and liner ply are laminated together and may be removed as one sheet from the combination.

The entire second surface of the liner ply includes a release coat and is adhered to the pressure sensitive adhesive on the surface of the film ply.

In practice, the multipart inspection form and label combination may be preprinted with variable and nonvariable information in a single pass. Additional variable information may then be added by the end user on site by passing the form through a printer. Where the present invention is used for a vehicle inspection, the variable information may include the owner's name, car model, year, etc. as well as the results of the inspection. A control number is also preferably printed by the manufacturer on the face ply in the first and second label portions of the combination, and bar coded information is preferably printed on the first label portion of the face ply.

After the inspection has taken place and the label has been printed with variable information by the end user, the peripheral matrix around the die cut label portion may then be removed to expose the adhesive on the film ply, and the label affixed to the windshield of a car so that the printed information on the label is visible through the windshield. The second portion is then either removed from the combination and used as a postcard, or peeled from the intermediate liner ply as a label which may be adhered to a postcard or other surface.

In embodiments where the form includes a third portion, the third portion is preferably removed and retained as a receipt by the vehicle owner.

Accordingly, it is a feature of the present invention to provide a multipart form and label combination which may be printed in a single pass and which includes at least one removable postcard or label portion. These, and other features and advantages of the present invention will become apparent from the following detailed description, the accompanying drawings, and the appended claims.

DETAILED DESCRIPTION OF THE PREFERRED EMBODIMENT

Figure 1A:
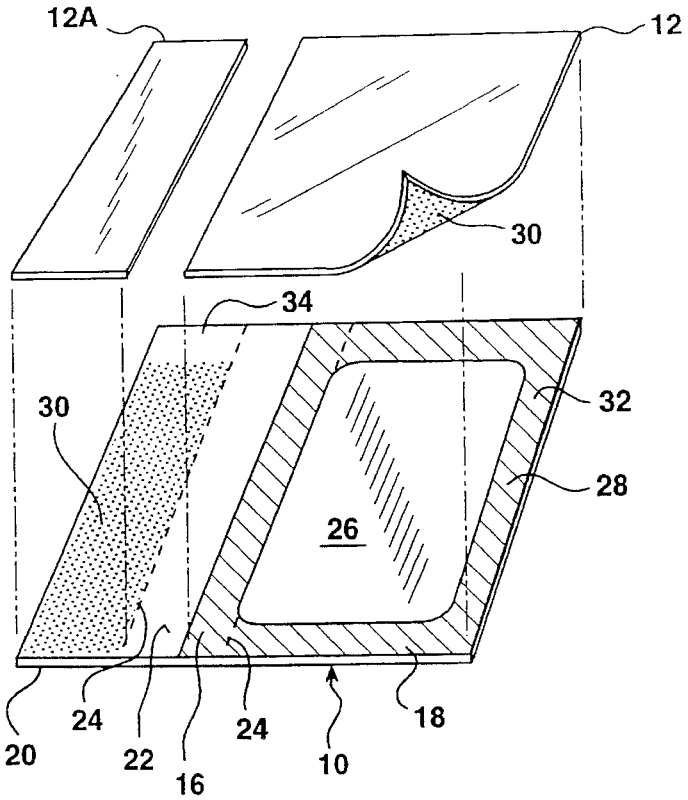
FIG. 1A is an exploded bottom view of the multipart form and label combination of the present invention.
Figure 1B:
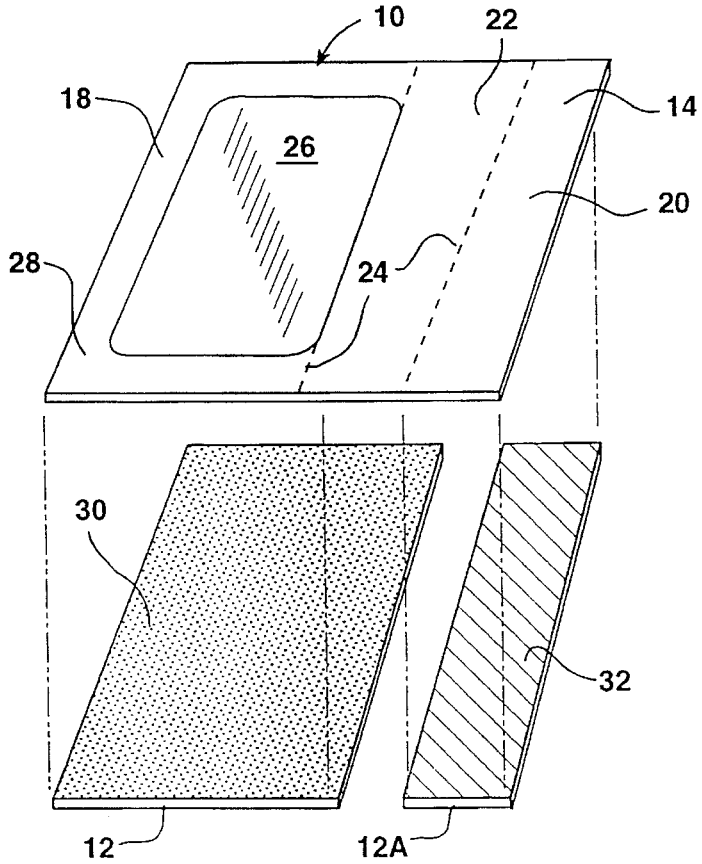
FIG. 1B is an exploded top view of the combination of FIG. 1A.
Figure 2:
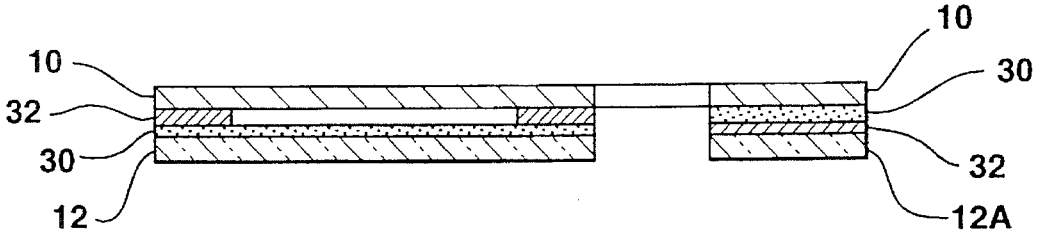
FIG. 2 is a cross-sectional view of the combination of FIG. 1B.
Figure 11:
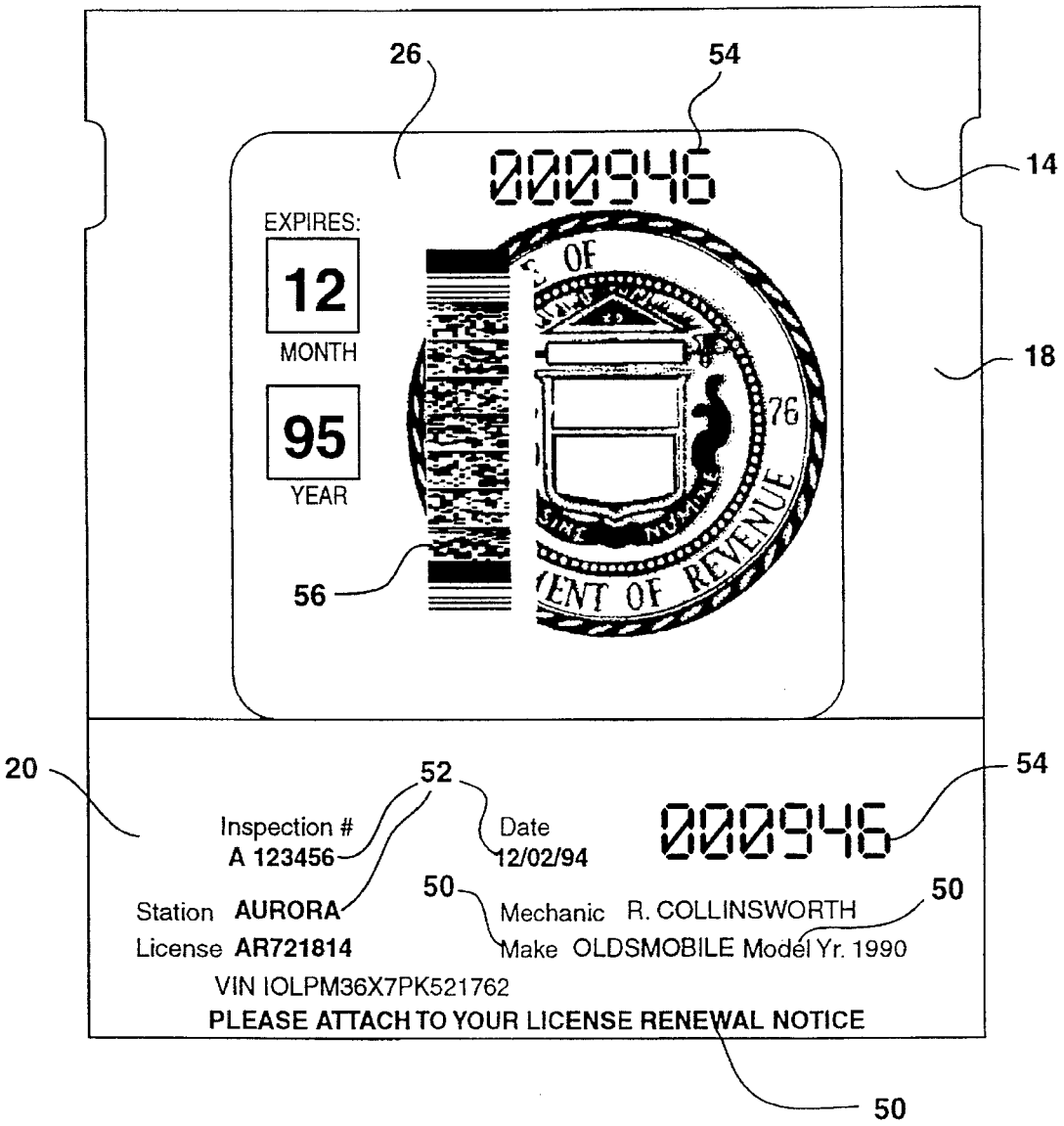
FIG. 11 is a top plan view of the multipart form and label combination.

Referring, collectively, to FIGS. 1A, 1B and FIG. 2, one embodiment of the multipart form and label combination is shown which comprises a printable face ply 10 and a film ply 12. The face ply 10 includes first surface 14 and second surface 16. The face ply is preferably comprised of thermal paper, but may also be comprised of any ink or toner receptive paper. The first surface 14 of the face ply is preferably printed with nonvariable and variable indicia as shown in FIG. 11. By nonvariable indicia, we mean repetitive information which is the same from form to form, while variable indicia refers to information which varies from form to form, such as control numbers, names, addresses, and the like.

The film ply may also have a printable surface and preferably comprises a transparent material such as a polymeric film, but may also comprise other materials such as paper, synthetic paper, or an opaque polymer sheet. Preferably, the film comprises a 2 mil (0.05 mm) thick polyester which is resistant to fading from ultraviolet light. If the film ply is printed with indicia, a fade resistant ink should be used.

The combination also includes first portion 18, second portion 20 and third portion 22, which are separable from one another. The first, second and third portions of the form and label combination are separated by perforations 24 which extend through the face ply 10. The removable portions may also be separated by die cuts. It should be appreciated that in the various embodiments of the invention, the perforations or die cuts may be used interchangeably as desired.

Figure 12:
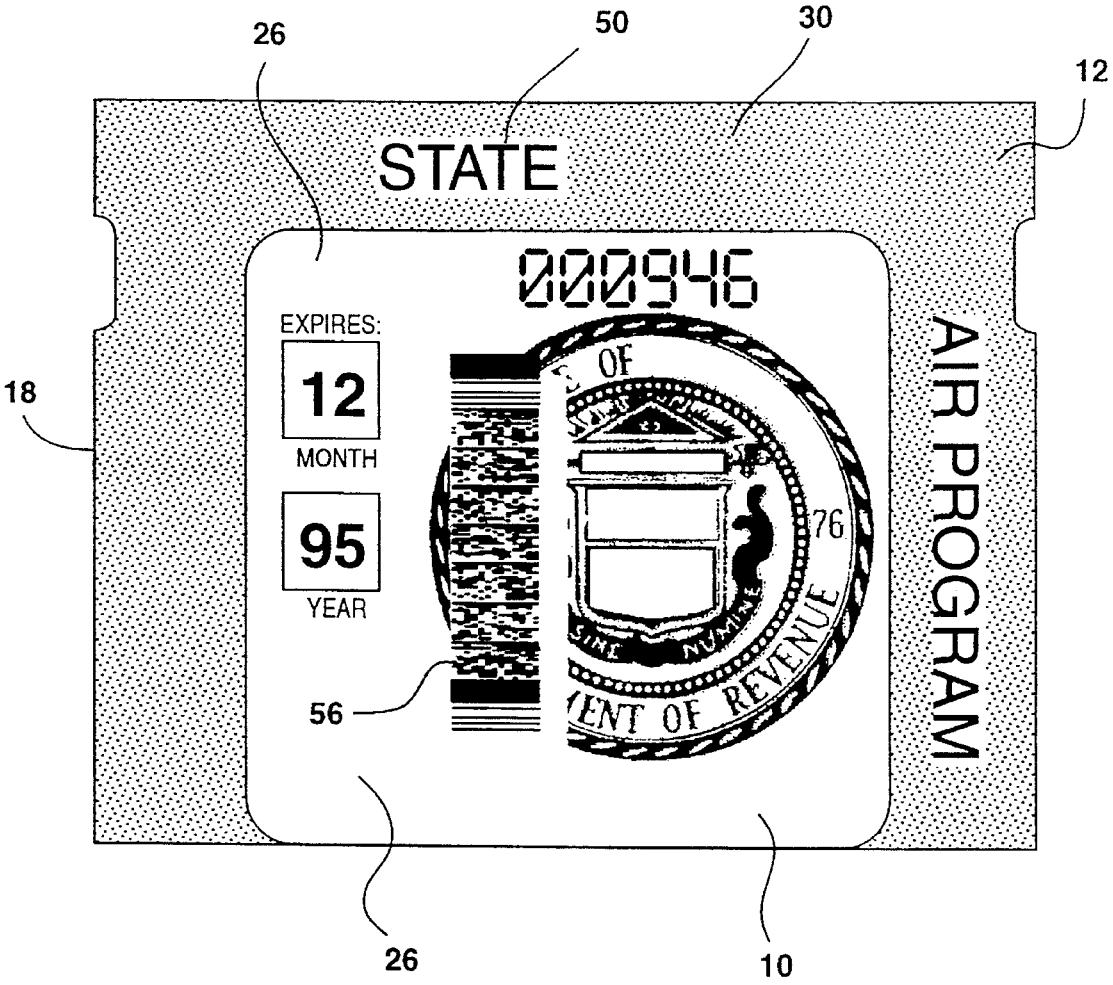
FIG. 12 is a top plan view of the first portion of the multipart form showing the removal of the peripheral matrix from the first portion.

The first portion 18 of the face ply includes a die cut label 26 having a removable peripheral matrix 28. In the embodiment shown, the portion of the film ply which is secured to the first portion 18 of the face ply 10 has a pressure sensitive adhesive 30 on its surface. Other suitable adhesives may also be used, such as permanent polymer latex adhesives. The second surface 16 of face ply 10 contains a release coat 32 on the peripheral matrix 28 of the label 26 such that the peripheral matrix may be readily peeled away from film ply 12, exposing the adhesive 30 as shown in FIG. 12. The label remains adhered to the film ply and the adhesive on the film ply which borders the label 26 is then used to adhere the label to a transparent surface such as a vehicle window.

As shown in FIG. 1A, second portion 20 of face ply 10 includes a pressure sensitive adhesive 30 on its second surface 16. A ply 12*a* is adhered to the second portion 20, and may comprise a separate material (paper, film or other sheet) as shown in FIGS. 1A and 1B, or may be a continuous film (not shown). Ply 12*a* includes a release coating 32 in contact with pressure sensitive adhesive 30 of the face ply so that the face ply may be peeled away from ply 12*a*. Preferably, one edge 34 of face ply 10 is free of adhesive to assist in removing the face ply from ply 12*a*. In some cases it may be preferred to use a dry residue fugitive adhesive instead of a pressure sensitive adhesive so that second portion 20 of the face ply is tack-free when peeled away.

In the embodiment shown in FIGS. 1 and 2, the film ply 12 is discontinuous over the third portion of the face ply 10. The third portion of the face ply 10 is preferably printed with indicia and retained as a receipt or record after the first and second portions are removed from the combination.

Figure 3A:
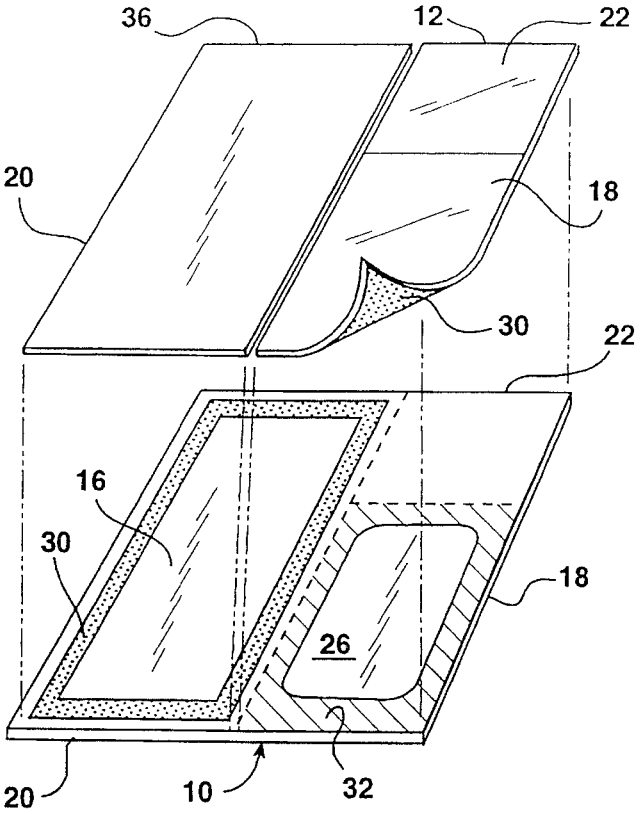
FIG. 3A is an exploded bottom view of an alternative embodiment of the invention.
Figure 3B:
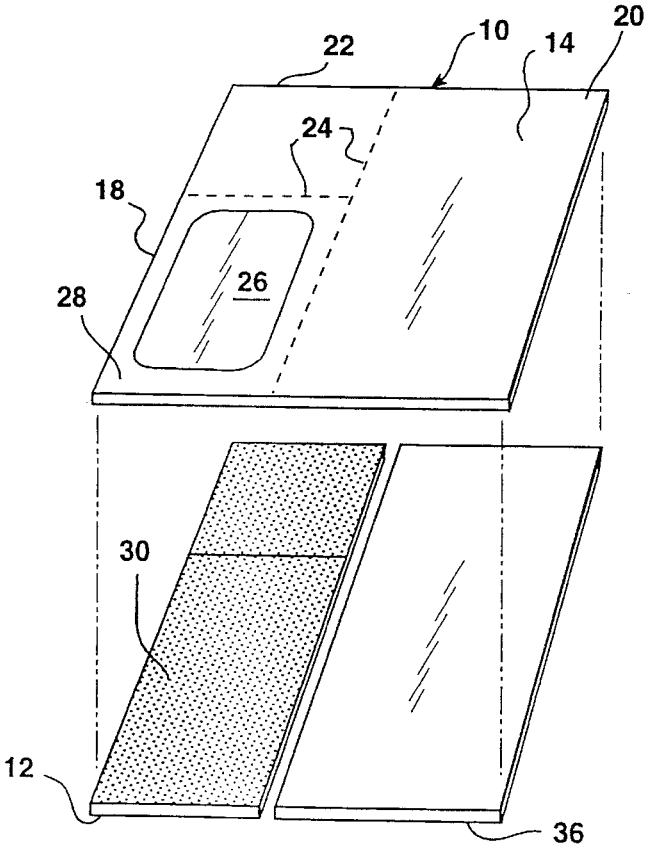
FIG. 3B is an exploded top view of the embodiment shown in FIG. 3A.
Figure 4:
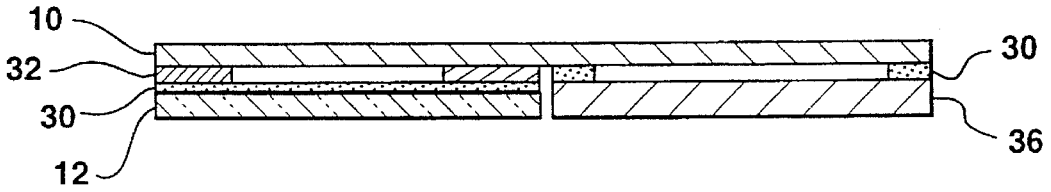
FIG. 4 is a cross-sectional view of the embodiment shown in FIG. 3B.

FIGS. 3A, 3B and 4 illustrate another embodiment of the invention in which face ply 10 is adhered to a film ply 12 and a paper ply 36. The combination includes first, second and third portions 18, 20 and 22 which are separated by perforations 24 extending through the face ply. As shown, the paper ply 36 is adhered to the second portion 20 of the face ply 10 while the film ply is adhered to the first and third portions 18 and 22 of the face ply.

The first portion 18 of the face ply includes a die cut label 26 having a removable peripheral matrix 28. As shown in FIG. 3B, the film ply has a pressure sensitive adhesive 30 on its surface. As shown in FIG. 3A, the second surface 16 of the first portion of the face ply 10 contains a release coat 32 on the peripheral matrix 28 of the label 26 such that the peripheral matrix may be readily peeled away from film ply 12, exposing the adhesive 30.

In the embodiment shown in FIG. 3A, the periphery of the second portion 20 of face ply 10 includes a pressure sensitive adhesive 30 which adheres to the paper ply 36. Thus, the face ply 10 and paper ply 36 are laminated together and may be removed as a single sheet from the combination. In this embodiment, the second portion is preferably printed with address information and used as a postcard.

The pressure sensitive adhesive 30 which adheres paper ply 36 to the second portion 20 of the face ply may be only partially coextensive with paper ply 36 and the second portion of face ply 10, as shown, or it may be fully coextensive. The pressure sensitive adhesive may be applied before lamination to either the paper ply 36 or to the second portion 20 of the face ply.

Figure 6:
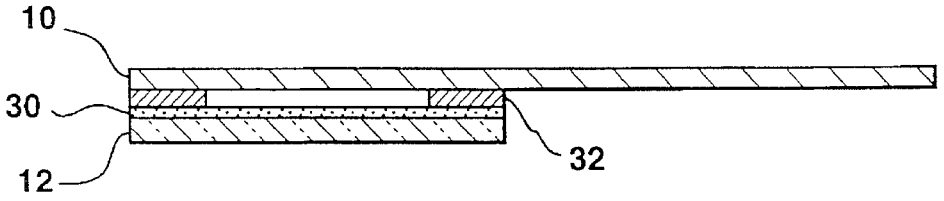
FIG. 6 is a cross-sectional view of the embodiment shown in FIG. 5B.
Figure 5A:
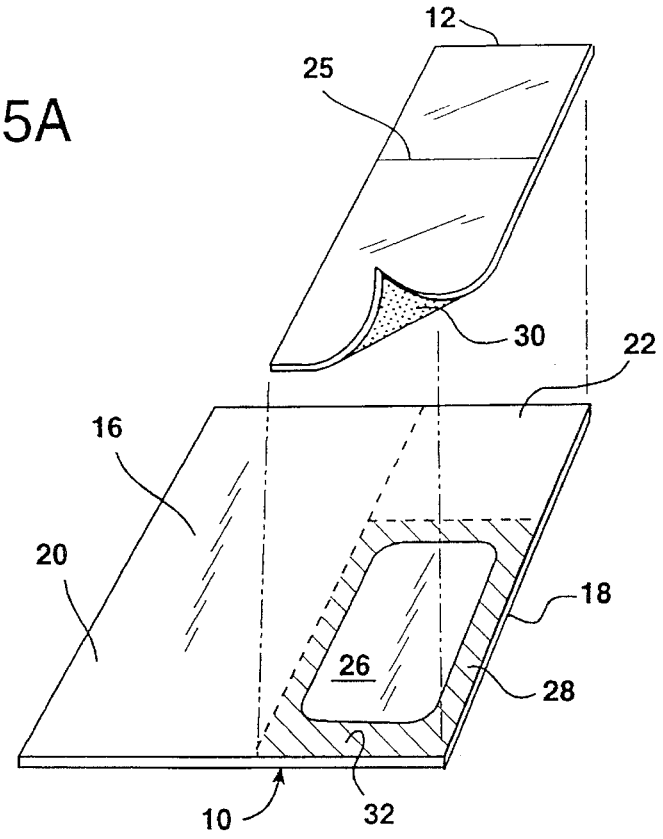
FIG. 5A is an exploded bottom view of another alternative embodiment of the invention.
Figure 5B:
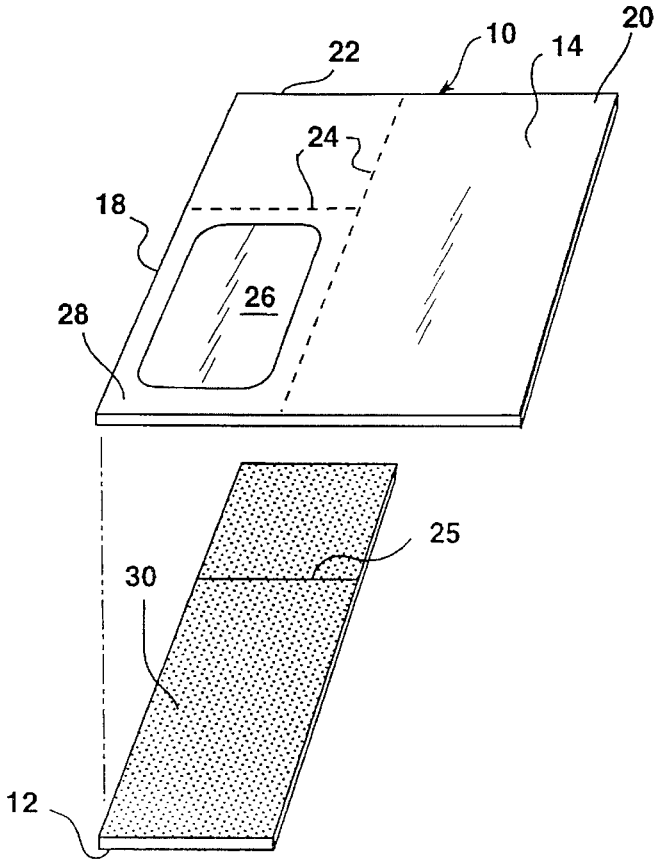
FIG. 5B is an exploded top view of the embodiment shown in FIG. 5A.

FIGS. 5A, 5B and 6 illustrate yet another embodiment of the invention including face ply 10 and a film ply 12. The film ply 12 includes a pressure sensitive adhesive 30 on its surface and is adhered only to the first and third portions of the face ply. The combination includes separable first, second and third portions 18, 20 and 22 which are separated by perforations 24 extending through the face ply. The face ply 10 of the first portion 18 includes die cut label 26 having a removable peripheral matrix 28. As shown in FIG. 5A, the second surface 16 of the face ply 10 contains a release coat 32 around the periphery of the peripheral matrix 28 of the first portion such that the peripheral matrix may be readily peeled from the film ply.

The second portion 20 is preferably in the form of a postcard and is comprised only of face ply 10. In this embodiment, the face ply is preferably comprised of a paper stock which is stiff enough to be used as a postcard without being laminated to another sheet. The third portion 22 is also separable from the combination and may be used as a receipt which is separated and retained by the customer.

Figure 7B:
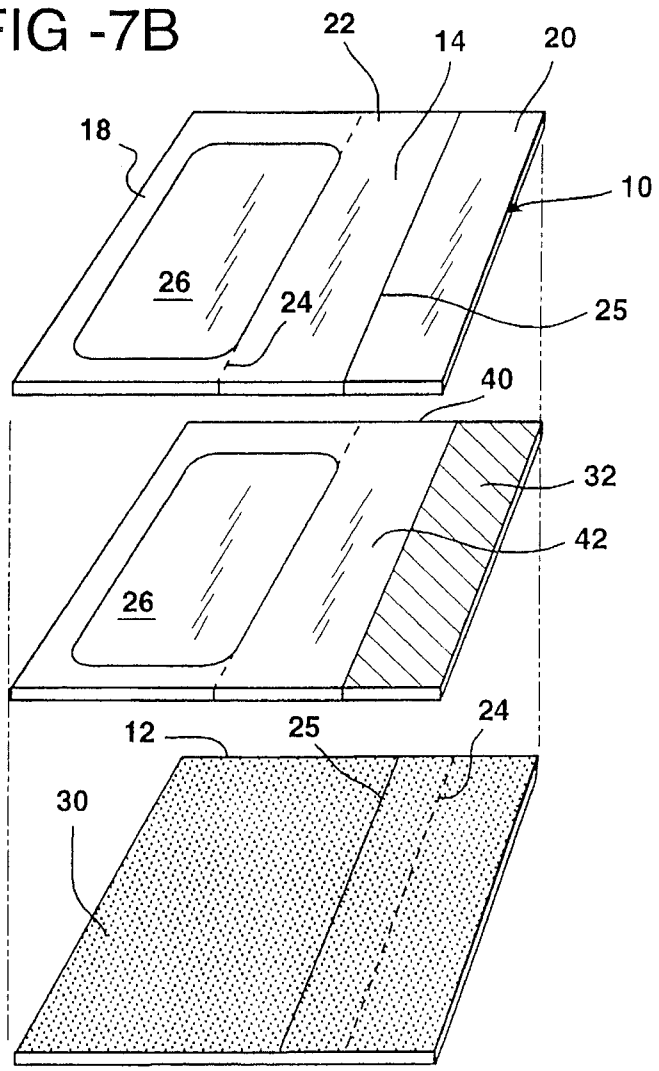
FIG. 7B is an exploded top view of the embodiment shown in FIG. 7A.
Figure 7A:
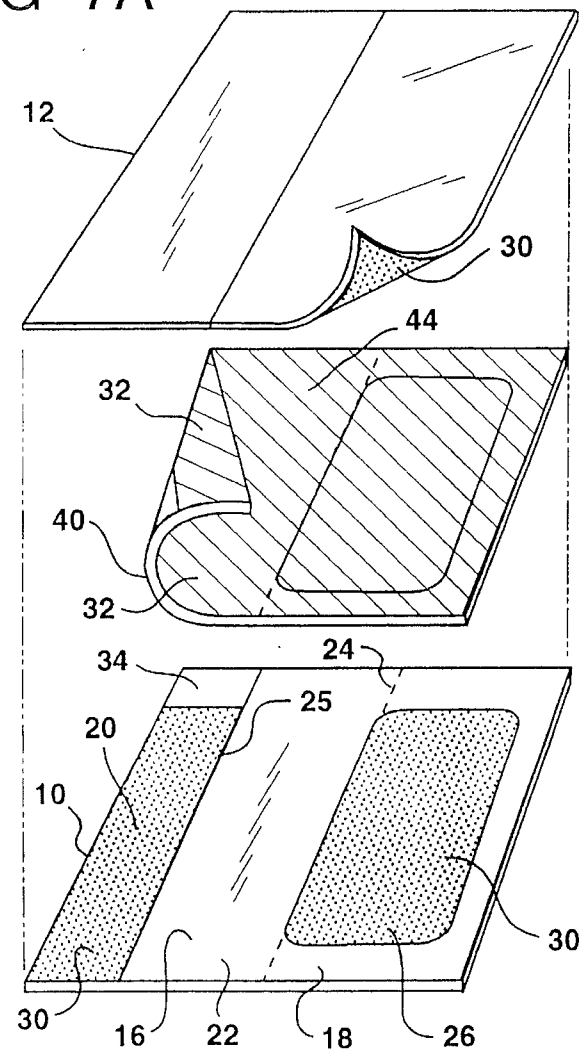
FIG. 7A is an exploded bottom view of a three-ply embodiment of the invention.
Figure 8:
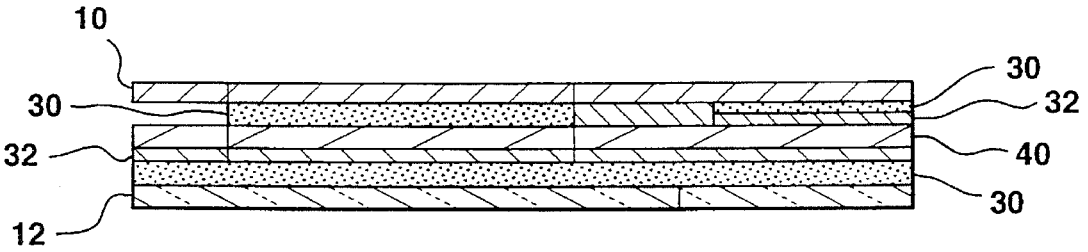
FIG. 8 is a cross-sectional view of the embodiment shown in FIG. 7B.
Figure 10:
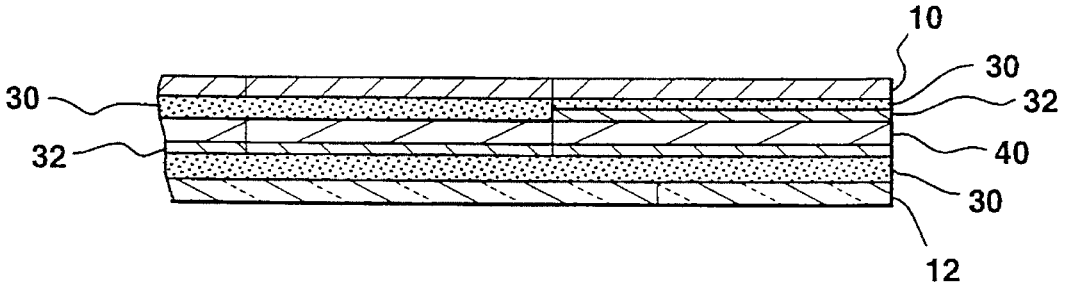
FIG. 10 is a cross-sectional view of the embodiment shown in FIG. 9B.

FIGS. 7A, 7B and 8 illustrate a preferred embodiment of the invention in which an intermediate liner ply 40 is included between the face ply 10 and film ply 12. The liner ply preferably comprises a 50 pound label liner paper. As shown, the face ply 10, intermediate liner ply 40, and film ply 12 are coextensive. The intermediate liner ply 40 includes first surface 42 and second surface 44, where the first surface 42 is adhered to the second surface 16 of the face ply and the second surface 44 is adhered to the film ply by pressure sensitive adhesive 30. The second surface of the liner ply includes a release coat 32 such that the liner ply is releasably adhered to the film ply.

The combination includes separable first, second and third portions 18, 20 and 22 which are separated by perforations 24 and die cuts 25 which extend through face ply 10 and liner ply 40. As shown, the film ply may also include die cuts 25 or perforations 24 corresponding to the boundaries of the first, second and third portions of the face ply and liner ply. This enables the film to remain adhered to the first, second or third portions when they are separated from one another.

As shown in FIG. 7A, the second surface 16 of the face ply 10 includes a pressure sensitive adhesive 30 on die cut label 26, and on the second portion 20. The first surface 42 of the liner ply of the second portion 20 includes a release coat 32 as shown in FIG. 7B such that the second portion of the face ply may be readily peeled from the liner ply. As shown in FIG. 7A, the second portion 20 of the face ply includes a clean lifting edge 34 which is free of adhesive to aid in peeling. In this embodiment, the second portion of the combination is preferably used as a label which is adhered to another surface.

FIGS. 9–12 illustrates another preferred embodiment of the invention in which a multipart inspection form and label combination is provided. While this embodiment is illustrated in the form of a vehicle inspection form, it should be appreciated that this embodiment of the present invention may be used for a number of different applications such as restaurant inspections, safety inspections, and the like.

The inspection form and label combination includes a face ply 10, an intermediate liner ply 40, and a film ply 12 which are coextensive. The face ply 10 has first and second major surfaces 14 and 16, with the first surface 14 containing nonvariable indicia 50 and variable indicia 52 as shown in FIG. 11. Such variable indicia may include information about the make and model of the car, or may include results from the inspection. As shown, the variable information preferably includes a control number 54 and bar coded information 56. The bar code shown is preferably a two-dimensional bar code which may contain encoded information such as the vehicle identification number, the make and model of the car, and inspection results. The bar coded information is preferably printed using a thermal printer where face ply 10 is of thermal paper while the control number is preferably printed using a laser or other type of printer.

Figure 9B:
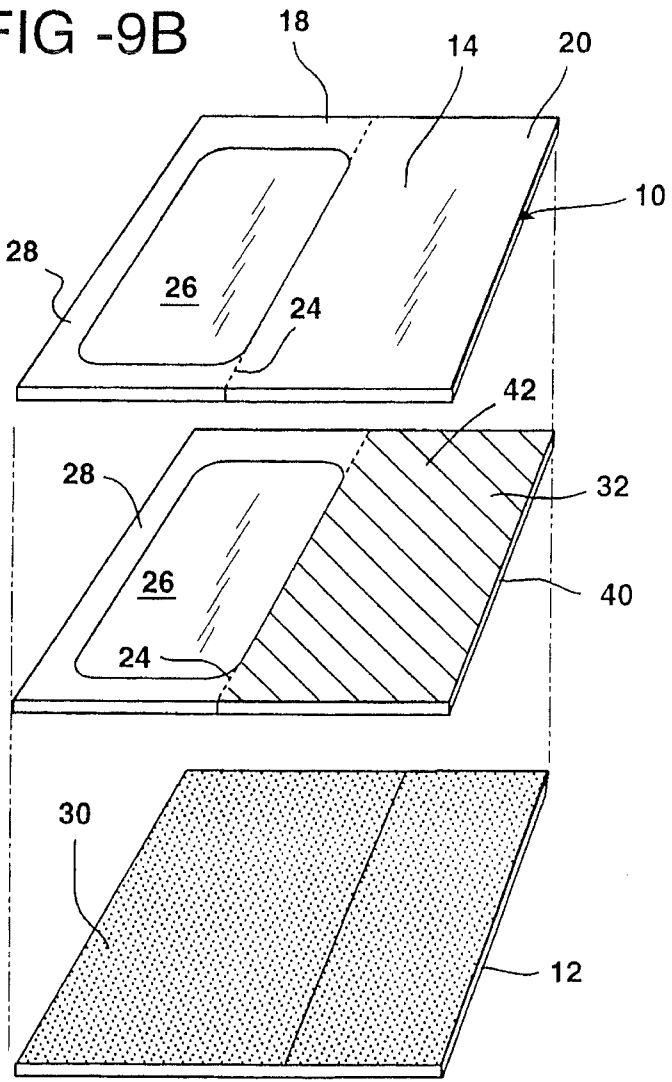
FIG. 9B is an exploded top view of another alternative embodiment of the invention.
Figure 9A:
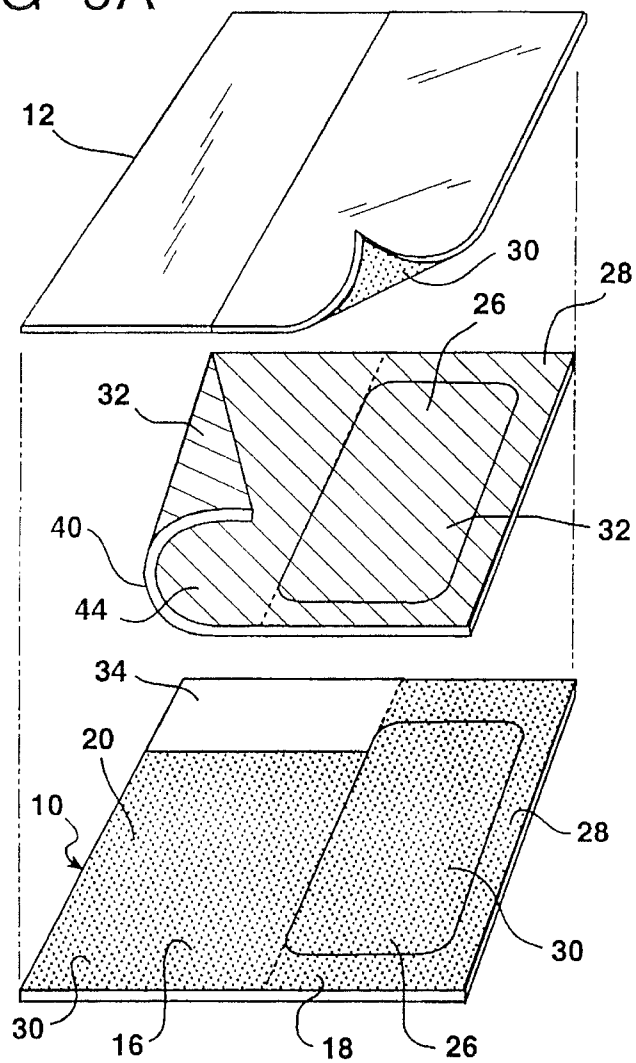
FIG. 9A is an exploded bottom view of another alternative embodiment of the invention.

As shown in FIG. 9A, the second surface 16 of the face ply 10 includes a pressure sensitive adhesive 30, which is adhered to the first surface 42 of intermediate ply 40. The second surface 44 of the intermediate liner ply includes a release coating 32 and is adhered to the film ply which includes a pressure sensitive adhesive 30 on its surface.

The multipart inspection form and label combination includes a separable first portion 18 which includes a die cut label 26 having a removable peripheral matrix 28. In use, after a vehicle inspection has taken place, the label portion 18 may be removed from the combination. The peripheral matrix 28 of the label 26 may then be removed from the film ply by peeling away the release coated surface 32 of the liner ply, exposing the adhesive 30 on film ply 12 as shown in FIG. 12. The label may then be placed adhesive side down onto the vehicle window of the owner. Where bar coded information is included on the label, a scanner may be used to read the encoded information through the windshield.

The second portion 20 is preferably used as a label or postcard and is defined by perforations 24 extending through the face ply and intermediate liner ply. As shown in FIG. 9B, the liner ply of the second portion includes a release coat 32 on its first surface 40 which adheres to the pressure sensitive adhesive on the second surface of face ply 10.

In the embodiment shown in FIG. 11, the second portion 20 comprises a label which has been printed with nonvariable information 50 and variable information 52. In this embodiment, the face ply of the second portion may be peeled away from the release coated liner ply 40 and adhered to a renewal notice for mailing to a vehicle bureau. As shown in FIG. 9A, a clean lifting edge 34 is provided to assist in separating the face ply and liner ply.

If desired, the second portion may comprise a postcard, where the second surface of the face ply is coated with a releaseable adhesive such that when the face ply is peeled from the intermediate liner ply, its second surface is tack free.

The multipart form and label combination of the present invention may be produced as a continuous web product or as a cut sheet or roll product. Preferably, the film ply and liner ply are adhered together on a roll. The liner is then coated with a release material such as a silicone polymer on its first surface. A pressure sensitive adhesive is then coated on the second surface of a printable face ply which is then laminated to the first surface of the liner ply. Nonvariable indicia may then be printed on the face ply in a single pass. Machine readable information such as bar coded information may also be printed on the face ply.

After preprinted nonvariable information is added to the web, the web is advanced through a die cutting station and/or a perforating station. The continuous web product is then ready for shipment to a customer where variable information may be added by the end user. The face ply may be printed with variable information by a number of different automated printing devices including impact printers, ion deposition printers, ink jet printers, laser printers, or thermal transfer printers.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A multipart form and label combination comprising:

a printable face ply having first and second major surfaces and a transparent, printable film ply having a pressure sensitive adhesive on at least a portion of one surface thereof adhered to said second major surface of said face ply; said combination including first and second portions which are separable from one another, said face ply of said first portion including a die cut label having a removable peripheral matrix to expose said adhesive on said film ply.

2. A combination as claimed in claim 1 in which said film ply is coextensive with said face ply.

3. A combination as claimed in claim 1 in which said film ply is adhered to said face ply of said first portion and a paper ply is adhered to said face ply of said second portion.

4. A combination as claimed in claim 1 in which said second surface of said face ply includes a release coating in the area comprising said peripheral matrix.

5. A combination as claimed in claim 1 in which at least a portion of said second surface of said face ply of said second portion includes a pressure sensitive adhesive.

6. A combination as claimed in claim 5 wherein said face ply includes a free-lifting edge to separate said face ply from said film ply.

7. A combination as claimed in claim 5 wherein said pressure sensitive adhesive is included around the periphery of said second surface of said face ply.

8. A combination as claimed in claim 5 in which the surface of said film ply adhered to said face ply includes a release coat.

9. A combination as claimed in claim 1 wherein said face ply includes printed nonvariable and variable indicia.

10. A combination as claimed in claim 1 wherein said film ply includes printed nonvariable indicia.

11. A combination as claimed in claim 1 wherein said face ply is thermally imagable.

12. A combination as claimed in claim 1 in which said first and second portions are separated by a die cut extending through said face ply.

13. A combination as claimed in claim 1 wherein said first and second portions are separated by perforations.

14. A combination as claimed in claim 1 including a third portion of said combination which is removable from said combination.

15. A combination as claimed in claim 14 wherein said third portion is separated from said first and second portions by a die cut extending through said face ply.

16. A combination as claimed in claim 14 wherein said third portion is separated from said first and second portions by perforations.

17. A combination as claimed in claim 1 including an intermediate liner ply between said face ply and said film ply.

18. A multipart form and label combination comprising:

a printable face ply having first and second major surfaces, an intermediate liner ply having first and second major surfaces, said first surface of said liner ply adhered to said second surface of said face ply, and a film ply having a pressure sensitive adhesive on one surface thereof adhered to said second surface of said liner ply; said combination including first and second portions which are separable from one another, said face ply and liner ply of at least said first portion including a die cut label having a removable peripheral matrix to expose said adhesive on said film ply.

19. A combination as claimed in claim 18 in which said face ply, intermediate liner ply, and said film ply are coextensive.

20. A combination as claimed in claim 18 in which said film ply is transparent.

21. A combination as claimed in claim 18 in which the liner ply of said second portion includes a release coat on said first surface of said liner ply.

22. A combination as claimed in claim 18 in which the second surface of said liner ply includes a release coat.

23. A combination as claimed in claim 18 in which said second surface of said face ply includes a pressure sensitive adhesive.

24. A combination as claimed in claim 18 in which said first and second portions are separated by a die cut extending through said face ply and said intermediate liner ply.

25. A combination as claimed in claim 18 in which said first and second portions are separated by perforations extending through said face ply and said intermediate liner ply.

26. A combination as claimed in claim 18 including a third portion of said combination which is removable from said combination.

27. A multipart inspection form and label combination comprising:

a) a face ply having first and second major surfaces, said first surface containing variable and nonvariable indicia, b) an intermediate liner ply having first and second major surfaces, said first surface of said liner ply adhered to said second major surface of said face ply, c) and a transparent, printable film ply adhered to said second surface of said intermediate liner ply with an adhesive; said combination including a first portion comprising a die cut label and a second portion, wherein said first and second portions are separable from one another.

28. The combination of claim 27 wherein said variable indicia includes a control number.

29. The combination of claim 28 wherein said second portion comprises a postcard.

30. The combination of claim 27 wherein said variable indicia includes a bar code.

31. The combination of claim 27 wherein said face ply, intermediate liner ply, and film ply are coextensive.

32. The combination of claim 27 wherein said second portion comprises a label.

* * * * *